US005113539A

United States Patent [19]

Strell

[11] Patent Number: 5,113,539

[45] Date of Patent: May 19, 1992

[54] ADJUSTABLE FIRMNESS COIL SPRING MATTRESS WITH INFLATABLE TUBES

[76] Inventor: Brian M. Strell, 454 Prospect Ave., West Orange, N.J. 07052

[21] Appl. No.: 738,574

[22] Filed: Jul. 31, 1991

[51] Int. Cl.[5] ..... A47C 27/10; A47C 27/04

[52] U.S. Cl. ..... 5/464; 5/475; 5/453; 5/455; 297/284 B; 297/DIG. 3

[58] Field of Search ..... 5/464, 475, 455, 449, 5/453, 477, 446, 447, 450; 297/284 B, DIG. 3

[56] References Cited

U.S. PATENT DOCUMENTS

| | | | |
|---|---|---|---|
| 1,772,310 | 8/1930 | Hart . | |
| 2,779,034 | 1/1957 | Arpin | 5/453 |
| 2,814,053 | 11/1957 | Sevcik | 5/455 |
| 3,089,154 | 5/1963 | Boyles | 5/447 |
| 3,166,768 | 1/1965 | Cunningham | 5/464 |
| 3,303,518 | 2/1967 | Ingram . | |
| 3,608,107 | 9/1971 | Kentor et al. . | |
| 4,357,724 | 11/1982 | Laforest | 5/449 |
| 4,449,261 | 5/1984 | Magnusson | 5/464 |
| 4,462,129 | 7/1984 | Brannock | 5/464 |
| 4,677,701 | 7/1987 | Galumbeck | 5/464 |
| 4,827,546 | 5/1989 | Cvetkovic | 5/449 |

FOREIGN PATENT DOCUMENTS

| | | | |
|---|---|---|---|
| 1261475 | 1/1972 | United Kingdom | 5/455 |

*Primary Examiner*—Alexander Grosz
*Attorney, Agent, or Firm*—Lerner, David, Littenberg, Krumholz & Mentlik

[57] ABSTRACT

A body supporting device such as mattresses, box springs, cushions and car seats having an inner coil spring structure are provided with adjustable firmness by means of a plurality of inflatable pneumatic members. The pneumatic members are positioned within the interstices formed between adjacent coil springs in a variety of patterns. The pneumatic members are connected to an inflation control device for adjusting the firmness of the body supporting device in varying modes, including a pulsation mode to provide a messaging affect.

20 Claims, 3 Drawing Sheets

ADJUSTABLE FIRMNESS COIL SPRING MATTRESS WITH INFLATABLE TUBES

BACKGROUND OF THE INVENTION

The present invention relates in general to body supporting devices, and more particularly, to mattresses and box springs having an inner coil spring structure and providing adjustable degrees of firmness by employing inflatable elongated pneumatic members arranged within the matrix of the inner coil spring structure.

A variety of mattress constructions are well known, such as the conventional coil spring mattress. Mattresses of the coil spring type are generally supplied in different degrees of firmness. For example, some mattresses are extremely soft and yieldable while others are relatively rigid and unyielding. Very often, a mattress requires a certain degree of rigidity for therapeutic purposes. Once a mattress of a particular firmness has been purchased, it cannot generally be changed without the necessity of having to purchase another mattress. For this reason, users frequently resort to the unsatisfactory technique of placing rigid boards and the like between the mattress and box spring, or within the mattress itself as known from Boyles, U.S. Pat. No. 3,089,154, in an attempt to control firmness.

The problem of supplying mattresses with various degrees of firmness is a considerable one. This applies to manufacturers who are typically required to maintain a large inventory of mattresses with different degrees of firmness. In addition, considerable difficulty arises with respect to hotels and the like which are often required to satisfy the particular requirements or tastes of its guests as to the firmness of the mattress in a particular room. For these reasons, it is desirable to provide a single mattress which easily adjusts to provide different degrees of firmness.

To this end, there is known from Arpin, U.S. Pat. No. 2,779,034, a mattress have an inner coil spring structure which is contained within a flexible, air impermeable cover. The firmness of the mattress is controlled by providing a vacuum within the cover by means of, for example, an ordinary household vacuum cleaner. In Ingram, U.S. Pat. No. 3,303,518 there is known an inflatable air mattress divided internally into separate sections or cells capable of independent inflation so as to vary the degree of softness or firmness to suit individual requirements. A similar inflatable air mattress constructed of individual inflatable cells enclosed within an outer casing is known from Hart, U.S. Pat. No. 1,772,310.

The latter two air mattresses disclosed in the Ingram and Hart patents are of the springless variety, more conventionally known simply as an air mattress and, therefore, do not possess the attributes of the much preferred inner coil spring mattress. To this end, there is known from Cvetkovic, U.S. Pat. No. 4,827,546, a pseudo coil spring mattress employing a plurality of accordian-like flexible bellows, which support an upwardly extending coil spring. The bellows are pressurized using air or water and interconnected in fluid communication with each other. As a result, the mattress vis-a-vis the flexible bellows is able to redistribute the pressure applied to it by the various parts of the human body.

There is further known from Laforest, U.S. Pat. No. 4,357,724 an inner coil spring mattress having adjustable firmness by virtue of the use of a pneumatic core. The pneumatic core is constructed as an inflatable bag, the upper surface being non-elastic, while the lower surface being of elastic rubber material supporting a plurality of protrusions which are adapted to be inserted into the mouth of some of the openings in the coil springs to insure lateral stability of the mattress. There is still further known from Kentor, et al. U.S. Pat. No. 3,608,107, an inner coil spring mattress having adjustable firmness by use of individual plunger mechanisms. Each plunger mechanism is concentrically arranged within a coil spring having adjustable stops to limit the degree of spring compression.

The aforementioned known mattresses having adjustable firmness lack the desired direct inner coil spring body support which can cause discomfort and disruption to the sleeping process. Accordingly, it is an object of the present invention to provide an adjustable firmness mattress having an inner coil spring structure integrated with elongated pneumatic members to enable varying degrees of firmness to promote maximum comfort and body support.

Another object of the present invention is to provide an adjustable firmness mattress which is easy and economical to manufacture.

Another object of the present invention is to provide an adjustable firmness mattress having a generally conventional inner coil spring structure.

SUMMARY OF THE INVENTION

In accordance with one embodiment of the present invention, there is provided an adjustable firmness body supporting device constructed of a plurality of coil springs arranged in a matrix of rows and columns, a cover extending about the matrix, and at least one elongated pneumatic member extending between the coil springs within the matrix.

In accordance with another embodiment of the present invention, there is provided an adjustable firmness body supporting device constructed of a plurality of inner coil springs arranged in a matrix of rows and columns, a plurality of elongated pneumatic members received within interstices formed between adjacent coil springs within the matrix, and means for inflating the pneumatic members to adjust the firmness of the mattress.

In accordance with another embodiment of the present invention, there is provided an adjustable firmness body supporting device constructed of a frame structure, a cover surrounding the frame structure, a plurality of inner coil springs arranged within and attached to the frame structure in a matrix of rows and columns, a plurality of elongated inflatable members received within the frame structure within interstices formed between adjacent inner coil springs within the matrix, and means for inflating each of the inflatable members to selectively adjust the firmness of the mattress.

BRIEF DESCRIPTION OF THE DRAWINGS

The above description, as well as further objects, features and advantages of the present invention will be more fully understood with reference to the following detailed description of the adjustable firmness mattress, when taken in conjunction with the accompanying drawings, wherein.

DESCRIPTION OF THE PREFERRED EMBODIMENTS

Figure 1:
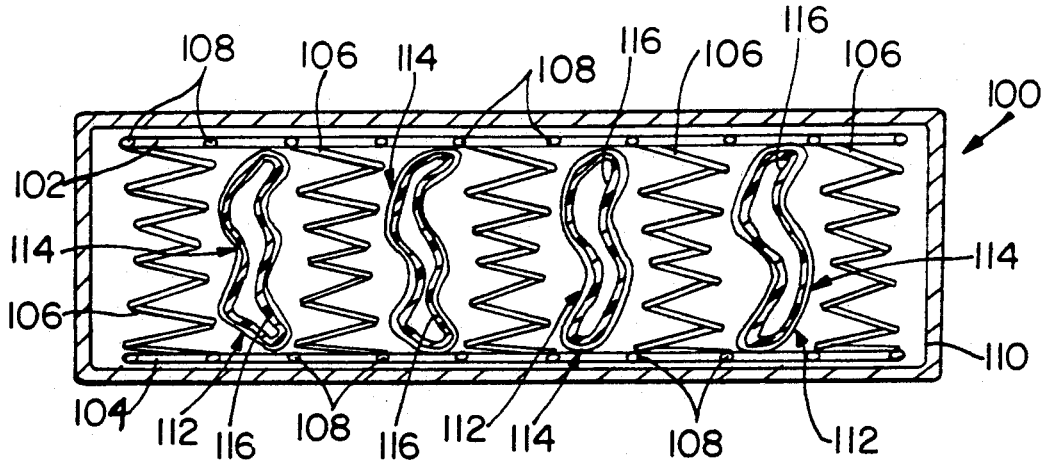
FIG. 1 is a cross sectional view of an adjustable firmness mattress constructed in accordance with the present invention having an inner coil spring structure and a plurality of elongated pneumatic members.

Referring now to the drawings, wherein like reference numerals represent like elements, there is shown in FIG. 1 an adjustable firmness mattress constructed in accordance with one embodiment of the present invention and designated generally by reference numeral 100. The mattress 100 is constructed generally as a conventional inner coil spring structure including an upper rectangular frame member 102 disposed overlying and spaced from a lower rectangular frame member 104. The frame members 102, 104 are maintained in spaced apart relationships by means of a plurality of inner coil springs 106 which are attached thereto such as, for example, at locations generally designated by reference numeral 108. In addition, the coil springs 106 are attached to each other typically by clips or a continuous coil wire. The frame members 102, 104 and inner coil springs 106 are surrounded by a conventional cover 110 of fabric and the like. It is to be understood that in certain situations the frame members 102, 104 may be removed from the mattress 100 if desired. As thus far described, the mattress 100 is of generally conventional construction to known inner coil spring mattresses which are mass marketed.

Figure 2:
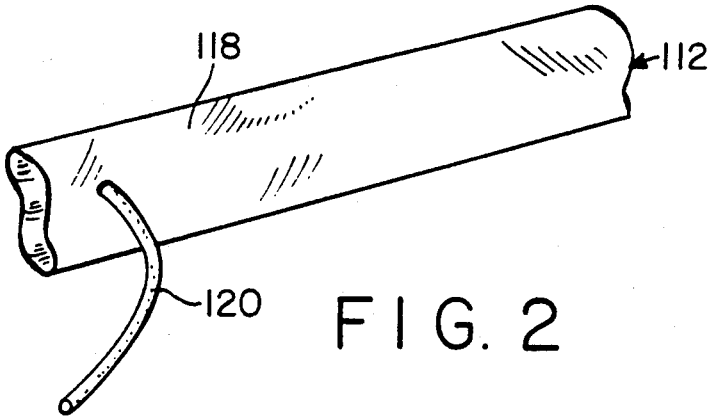
FIG. 2 is a perspective view of a pneumatic member employed in accordance with the present invention.

In accordance with the present invention, a plurality of elongated pneumatic members 112 are received within the interstices 114 formed between adjacent coil springs 106. The pneumatic members 112 are in the nature of elongated inflatable bladders 116 which may be constructed from a variety of materials such as neoprene, butyl rubber and alike. Optionally, the bladder 116 may be covered exteriorly by a cloth cover 118 which prevents squeaking which might otherwise result from rubbing of the bladder 116 against adjacent coil springs 106. Each of the pneumatic members 112 are supplied with an inflation tube 120, see FIG. 2, to enable inflation of the bladder 116 in adjusting the firmness of the mattress 100 as to be described hereinafter. In addition, the bladders 116 share the load with coil springs 106, resulting in longer spring life and help support worn springs to extend their life.

Figure 3:
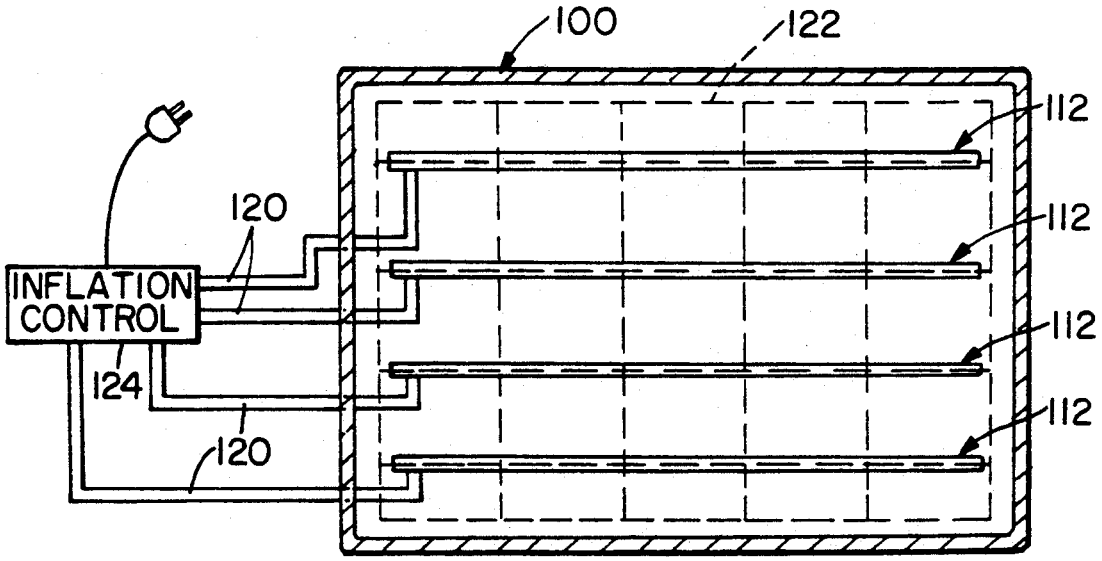
FIG. 3 is a diagrammatic illustration of an inflation control system for the pneumatic members in accordance with one embodiment of the present invention.

Referring now to FIG. 3, the arrangement of the pneumatic members 112 in accordance with one embodiment of the present invention will now be described. The inner coil springs 106, as in a conventional inner coil spring mattress, are arranged in a matrix 122 of rows and columns as illustrated diagrammatically by the dash lines. In the embodiment illustrated, the pneumatic members 112 are arranged extending longitudinally within the matrix 122 within the interstices 114 formed between adjacent coil springs 106 from the foot end to the head end of the mattress 100. The pneumatic members 112 may be positioned within the interstices 114 formed between each row of coil springs 106, every other row and the like, as well as selectively within those portions of the mattress 100 where adjustable firmness is desired.

The inflation tubes 120 from each of the pneumatic members 112 are connected to an inflation control device 124, either individually or through one or more common manifolds via solenoid valves or the like. The inflation control device 124 contains an electric air compressor of sufficient size to enable inflation of the pneumatic members 112 to a sufficient pressure to achieve the desired firmness sought. The inflation of the pneumatic members 112 may be controlled in a variety of modes. For example, each of the pneumatic members 112 may be inflated to the same pressure simultaneously or to different pressures to provide different portions of the mattress 100 with varying degrees of firmness. In addition, the pressure within the pneumatic members 112 may be pulsed between an upper and lower level by means of the inflation control device 124 to create a messaging affect.

The operation of the inflation control device 124, as well as it component parts, may be by means of a programmed microprocessor. It is to be understood that the present invention resides in the construction and arrangement of the pneumatic members 112 within the matrix 122 of the coil springs 106 of the mattress 100, and therefore, other means of causing inflation of the pneumatic members 112 other than the thus far described inflation control device 124 may be provided without departing from the present invention.

Figure 4:
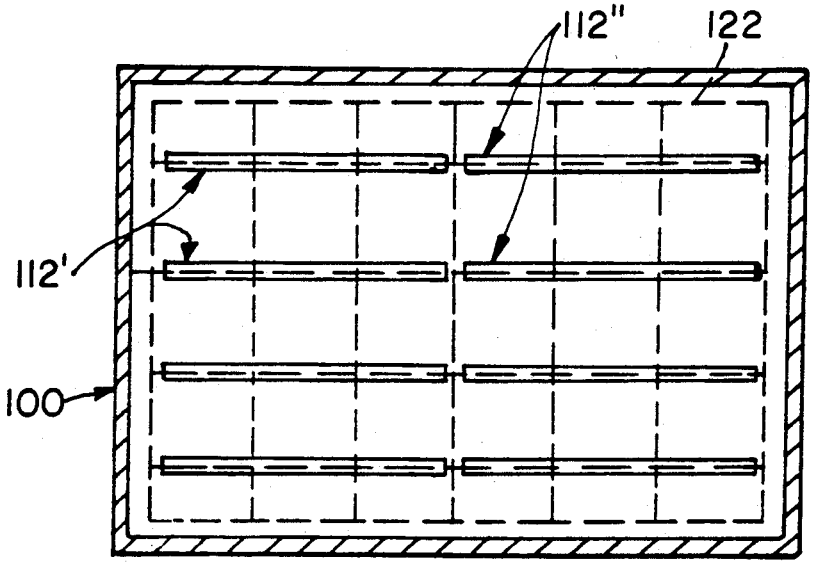
FIG. 4 is a diagrammatic illustration of an arrangement of the pneumatic members in accordance with FIG. 5 is a diagrammatic illustration of the arrangement of the pneumatic members in accordance with another embodiment of the present invention.

Referring now to FIG. 4, another embodiment of the arrangement of the pneumatic members 112 within the matrix 122 of coil springs 106 is diagrammatically illustrated. In the disclosed embodiment, the pneumatic members are arranged in two separate groups designated respectively 112' and 112". The first group 112' extends longitudinally within the interstices 114 over a first portion of the mattress 100. Similarly, the second group of pneumatic members 112" extends over another portion of the mattress 100. In the particular embodiment illustrated, the pneumatic members 112', 112" of each of the groups are arranged in co-linear alignment. However, it is to be understood that the pneumatic members 112', 112" of the two groups may be arranged offset from one another or in other particular arrangements if so desired. Each of the pneumatic members 112', 112", will be connected to the inflation control device 124 as thus far described.

By the aforementioned arrangement, different portions of the mattress 100 may be inflated to provide varying degrees of firmness as best suits the individual. It is to be understood that the pneumatic members 112', 112" may be positioned in other than every row within the matrix 122 and can be individually or collectively connected to the inflation control device 124 for operation in the aforementioned modes. In this regard, the pneumatic members 112', 112" may be inflated individually, in groups or simultaneously, as well as in the pulsation mode previously described.

Figure 5:
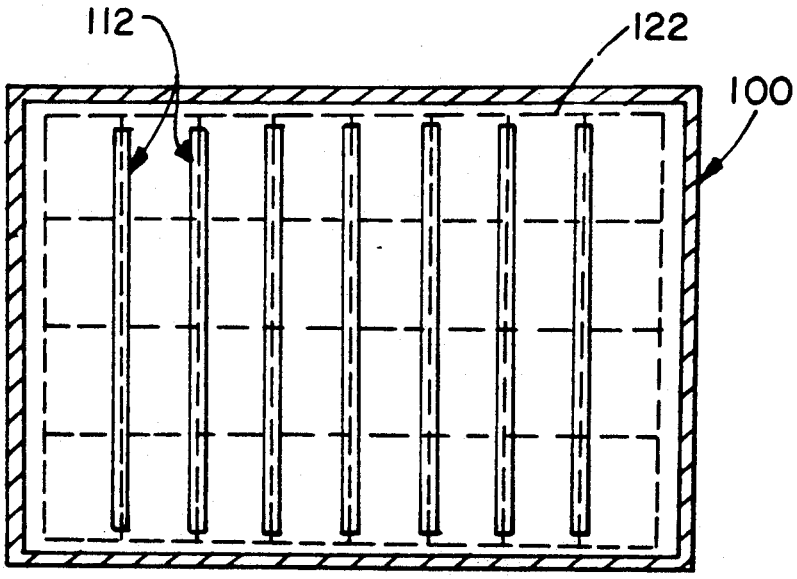

Referring now to FIG. 5, there is disclosed another embodiment of the arrangement of pneumatic members 112 pursuant to the present invention. As shown, the pneumatic members 112 are arranged within the interstices 114 formed between columns of coil springs 106 arranged within the matrix 122. As such, the pneumatic members 112 extend transversely of the mattress 100. Based upon the interrelationship between the pneumatic members 112 and the coil springs 106 pursuant to this arrangement, it is contemplated that the pneumatic members might affect the coil springs adversely to make the surface of the mattress 100 lumpy if inflated to unequal pressures. It is therefore preferred that the pneumatic members 112 be inflated uniformly.

Figure 6:
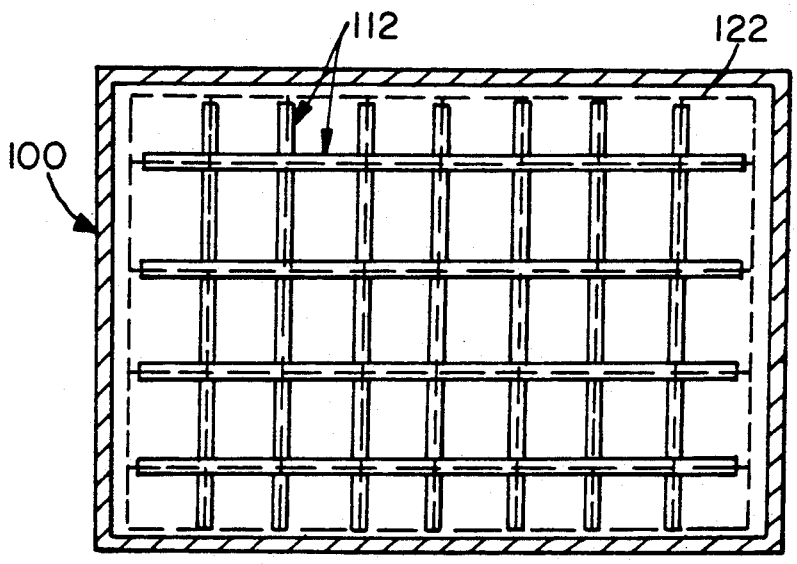
FIG. 6 is a diagrammatic illustration of the arrangement of the pneumatic members in accordance with another embodiment of the present invention.

Referring now to FIG. 6, there is disclosed another arrangement of the pneumatic members 112 in accordance with still another embodiment of the present invention. As shown, the pneumatic members 112 are arranged in a matrix of rows and columns formed between the interstices 114 of the coil springs 106. As previously described, it is not necessary that the pneumatic members 112 be placed within each row and column of the matrix 122 of coil springs 106. Similarly, the pneumatic members 112 may be arranged in a matrix of rows and columns in two or more groups covering different portions of the mattress 100 in the manner as described with respect to the embodiment disclosed in FIG. 4. Each of the pneumatic members 112 are connected to the inflation control device 124 which may be operated in a variety of modes so as to inflate the pneumatic members either individually, simultaneously, in groups and the like, as well as in the pulsation mode previously described.

Figure 7:
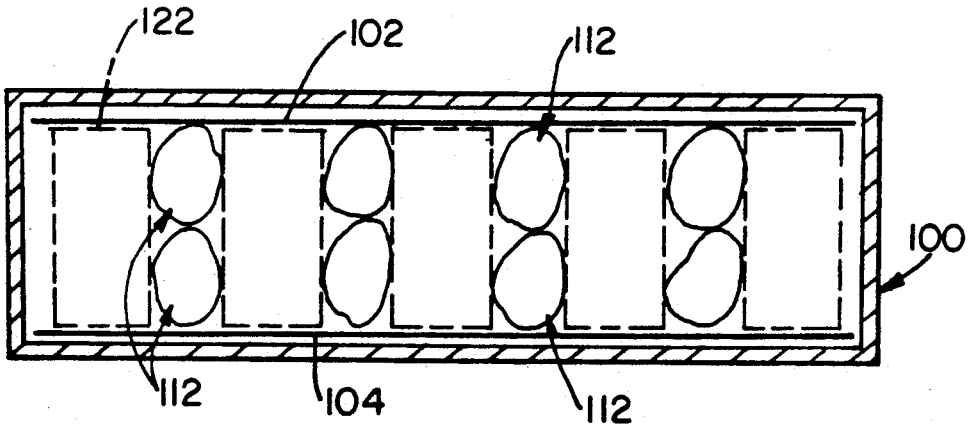
FIG. 7 is a diagrammatic illustration of the arrangement of the pneumatic members in accordance with another embodiment of the present invention.

Referring now to FIG. 7 there is further diagrammatically illustrated another embodiment of the present invention. As shown, the pneumatic members 112 are arranged in pairs one on top of the other within the interstices 114 formed between adjacent coil springs 106 within the matrix 122. In this manner, adjustable firmness of the top and bottom surfaces of the mattress 100 may be obtained independently. The pneumatic members 112 may be arranged within the matrix 122 in the various embodiments as illustrated in FIGS. 3 through 6. Similarly, each of the pneumatic members are connected to the inflation control device 124 to provide varying degrees of firmness to the mattress 100 as previously described.

Although the invention herein has been described with reference to particular embodiments, it is to be understood that the embodiments are merely illustrative of the principles and application of the present invention. For example, the present invention may be used to provide adjustable firmness to box springs, cushions, car seats and the like. It is therefore to be understood that numerous modifications may be made to the embodiments and that other arrangements may be devised without departing from the spirit and scope of the present invention as defined by the claims.

What is claimed is:

1. An adjustable firmness body supporting device comprising a plurality of coil springs arranged in a matrix of a plurality of rows and columns, said matrix providing a body supporting portion of said device, a cover extending about said matrix, at least one elongated pneumatic member extending between adjacent coil springs within said matrix, said member being located within interstices formed between upper, lower and peripheral portions of adjacent coil springs within said matrix, said member acting on at least said adjacent coil springs to effect the firmness of said body supporting portion provided by at least said adjacent coil springs.

2. The adjustable firmness body supporting device of claim 1, further including a plurality of elongated pneumatic members extending between said coil springs within said matrix, at least two of said plurality of pneumatic members being separated by at least one row or column of said coil springs.

3. The adjustable firmness body supporting device of claim 2, wherein said elongated pneumatic members are arranged between said rows of said coil springs within said matrix.

4. The adjustable firmness body supporting device of claim 2, wherein said elongated pneumatic members are arranged between said columns of said coil springs within said matrix.

5. The adjustable firmness body supporting device of claim 2, wherein said elongated pneumatic members are arranged between said rows and columns of said coil springs within said matrix.

6. The adjustable firmness body supporting device of claim 2, wherein said elongated pneumatic members are arranged in a first group extending within a portion of said matrix and a second group extending within another portion of said matrix.

7. The adjustable firmness body supporting device of claim 2, wherein said elongated pneumatic members are arranged one on top of the other within said matrix.

8. The adjustable firmness body supporting device of claim 1, further including a flexible cover surrounding said elongated pneumatic member.

9. The adjustable firmness body supporting device of claim 1, further including means for inflating said elongated pneumatic member to adjust the firmness of said mattress.

10. The adjustable firmness body supporting device of claim 1, wherein said rows and columns are arranged closely spaced to each other.

11. The adjustable firmness body supporting device of claim 10, wherein said elongated pneumatic member is confined within the interstices formed between adjacent closely spaced coil springs within said matrix.

12. The adjustable firmness body supporting device of claim 1, wherein one end of said coil springs provide a body supporting surface extending within said matrix over the extent of said device, and said elongated pneumatic member is arranged within the interstices formed between adjacent coil springs below said body supporting surface.

13. An adjustable firmness body supporting device comprising a plurality of inner coil springs arranged in a matrix of a plurality of rows and columns, a plurality of elongated pneumatic members received within interstices formed between upper, lower and peripheral portions of adjacent coil springs within said matrix, and means for inflating said pneumatic members to adjust the firmness of said mattress, whereby said pneumatic members act upon at least said adjacent coil springs to effect the firmness of said body supporting portion provided by at least said adjacent inner coil springs.

14. The adjustable firmness body supporting device of claim 13, wherein said elongated pneumatic members are arranged between said rows of said coil springs within said matrix.

15. The adjustable firmness body supporting device of claim 13, wherein said elongated pneumatic members are arranged between said columns of said coil springs within said matrix.

16. The adjustable firmness body supporting device of claim 12, wherein said elongated pneumatic said coil springs within said matrix.

17. The adjustable firmness body supporting device of claim 13, wherein said elongated pneumatic members are arranged in a first group extending within a portion of said matrix and a second group extending within another portion of said matrix.

18. The adjustable firmness body supporting device of claim 13, wherein said elongated pneumatic members are arranged one on top of the other within said matrix.

19. The adjustable firmness body supporting device of claim 13, further including a flexible cover surrounding said elongated pneumatic members.

20. An adjustable firmness body supporting device comprising a frame structure, a plurality of inner coil springs arranged within and attached to said frame structure in a matrix of a plurality of rows and columns, a plurality of elongated inflatable members received within said frame structure within interstices formed between upper, lower and peripheral portions of adjacent inner coil springs within said matrix, and means for inflating each of said inflatable members to selectively adjust the firmness of said mattress, whereby said members act upon said adjacent inner coil springs to effect the firmness of said body supporting portion provided by said adjacent inner coil springs.

* * * * *

UNITED STATES PATENT AND TRADEMARK OFFICE

CERTIFICATE OF CORRECTION

PATENT NO. : 5,113,539

DATED : May 19, 1992

INVENTOR(S) : Brian M. Strell

It is certified that error appears in the above-identified patent and that said Letters Patent is hereby corrected as shown below:

Column 3, Line 9, "in accordance with" should read --in accordance with another emodiment of the present invention;--.

Column 7, Line 2, "pneumatic said" should read --pneumatic members are arranged between said rows and columns of said--.

Signed and Sealed this

Twenty-sixth Day of October, 1993

*Attest:*

Bruce Lehman

BRUCE LEHMAN

*Attesting Officer*

*Commissioner of Patents and Trademarks*